US009938827B2

(12) United States Patent
Beller

(10) Patent No.: US 9,938,827 B2
(45) Date of Patent: Apr. 10, 2018

(54) END PLATE INTERLOCK FOR HOUSING OF A GROUND BREAKING MACHINE AND METHOD OF MOUNTING A CUTTER DRUM IN THE HOUSING

(71) Applicant: Larry D. Beller, Blanchard, OK (US)

(72) Inventor: Larry D. Beller, Blanchard, OK (US)

( * ) Notice: Subject to any disclaimer, the term of this patent is extended or adjusted under 35 U.S.C. 154(b) by 194 days.

(21) Appl. No.: 15/141,095

(22) Filed: Apr. 28, 2016

(65) Prior Publication Data

US 2017/0314392 A1 Nov. 2, 2017

(51) Int. Cl.
*E01C 23/088* (2006.01)
*E21C 25/08* (2006.01)
*E21C 25/10* (2006.01)

(52) U.S. Cl.
CPC ..... *E21C 25/08* (2013.01); *E21C 25/10* (2013.01); *E01C 23/088* (2013.01)

(58) Field of Classification Search
CPC ..... E01C 23/12; E01C 23/088; E01C 23/09
USPC ..... 299/36.1, 39.1, 39.2, 39.4, 39.5, 39.6, 299/1.4, 1.5, 1.9; 404/90–94, 75, 76
See application file for complete search history.

(56) References Cited

U.S. PATENT DOCUMENTS 3,540,360 A 11/1970 Snow et al.
3,946,506 A 3/1976 Snow et al.
4,325,580 A 4/1982 Swisher, Jr. et al.
4,704,045 A * 11/1987 Taylor ..... E01C 23/088 172/112
5,259,692 A 11/1993 Beller et al.
5,362,176 A 11/1994 Sovik
5,505,598 A 4/1996 Murray
6,283,672 B1 9/2001 Sovik
(Continued)

FOREIGN PATENT DOCUMENTS

AU 198768019 A 1/1987
DE 102004025567 A1 * 10/2005
DE 102012012607 A1 * 1/2014

*Primary Examiner* — Sunil Singh
(74) *Attorney, Agent, or Firm* — McKee, Voorhees & Sease, PLC

(57) ABSTRACT

A ground breaking machine has a housing and the housing has oppositely disposed end plates which have aligned axial female openings and matching male plate portions positioned in the female openings. The female opening is defined by a side edge having top and oppositely disposed vertical spaced apart side edge portions. Each of the vertical side edge portions terminate in a laterally inwardly extending portion having an upperwardly extending hook portion engageable with a downwardly extending hook portion on the male plate portion for interlocking the female and male hook portions to prevent separation thereof and separation of the male plate portion in the female opening.

The method of assembly and mounting the cutter drum in the housing includes the steps of providing a housing having oppositely disposed end plates including aligned axial openings and matching male plate portions for being positioned in the female openings. The cutter drum has a gear drive mounted in an end of the cutter drum and is provided with a hydraulic motor on one of the male plate portions. The cutter drum is positioned under the housing and the male plate portion having the hydraulic motor is positioned in the female opening in an end plate. The hydraulic motor on the male plate portion is connected to the gear drive in the end of the cutter drum.

6 Claims, 8 Drawing Sheets

(56) References Cited

U.S. PATENT DOCUMENTS

| | | | |
|---|---|---|---|
| 6,322,287 | B1 | 11/2001 | Yelton |
| 6,481,123 | B1 | 11/2002 | Kanzler et al. |
| 6,554,080 | B2 | 4/2003 | Horner |
| 7,104,510 | B2 | 9/2006 | Beller |
| 7,364,096 | B1 | 4/2008 | Sosnowski et al. |
| 7,472,869 | B2 | 1/2009 | Beller |
| 8,474,919 | B2 | 7/2013 | Cipriani et al. |
| 8,714,660 | B2 | 5/2014 | Rodel et al. |
| 2003/0161684 | A1 | 8/2003 | Quenzi |
| 2010/0143036 | A1 | 6/2010 | Rayner |
| 2011/0311309 | A1 | 12/2011 | Hartwich et al. |
| 2014/0270953 | A1 | 9/2014 | Duffy |

* cited by examiner

END PLATE INTERLOCK FOR HOUSING OF A GROUND BREAKING MACHINE AND METHOD OF MOUNTING A CUTTER DRUM IN THE HOUSING

BACKGROUND OF THE INVENTION

Ground breaking or crushing machines typically utilize a cutter drum with teeth. The machine will have means for varying the crushing depth. It is desirable to crush at varying depths with a cutter drum of minimum diameter. The depth of cut a typical crusher machine is limited by the downward extension of the housing end plates holding the cutter drum. End plates ordinarily need to extend a substantial distance below the axis of the cutter drum in order to provide the required strength to hold the cutter drum during the crushing operation.

Thus, what is needed is a crusher with cutter drum housing end plates which have a minimum height thus maximizing the cutting depth for the cutter drum. Strengthening means for the shorten end plates must be provided.

SUMMARY OF THE INVENTION

The end plates of the ground breaking machine housing include aligned axial female openings and matching male plate portions positioned in the female openings. The female openings are defined by side edges having top and oppositely disposed vertical spaced apart edge portions. Each of the vertical side edge portions terminate in a laterally inwardly extending end portion having a upperwardly extending hook portion engagable with a downwardly extending hook portion on the male plate portion for interlocking the female and male hook portions to prevent separation thereof and separation of the male plate portion in the female opening.

The male plate portion is cut out of an approximate 2 inch steel end plate leaving an approximate ⅛ inch gap allowing misalignment between the male plate portion and the steel end plate. The bottom of the male plate portion will not extend below the bottom surface of the cutter drum thus not limiting the cutting depth of the cutter drum teeth.

The method of assembly and mounting of a cutter drum in the housing of a ground breaking machine of this invention is an embodiment of this invention. A housing having oppositely disposed end plates including aligned axial female openings and matching male plate portions for being positioned in the female openings is provided. A gear drive is mounted in an end of the cutter drum. A hydraulic motor is connected to one of the male plate portions. A cutter drum is positioned under the housing. The male plate portion having the hydraulic motor on an end plate portion is positioned in the female opening and the hydraulic motor is connected to the gear drive in the end of the cutter drum. The male plate portion is cut out of the end plate having the female opening into which the male plate portion is to be positioned. A gap of approximate ⅛ inch is provided allowing a minuet misalignment of the male plate portion in the matching female opening. The end plate will have a thickness of approximately 2 inches for strength and providing for any misalignment when male plate portion is positioned in the matching female opening. The cutter drum may be powered for rotation from a single end and/or both ends.

DETAILED DESCRIPTION OF THE INVENTION

Figure 1:
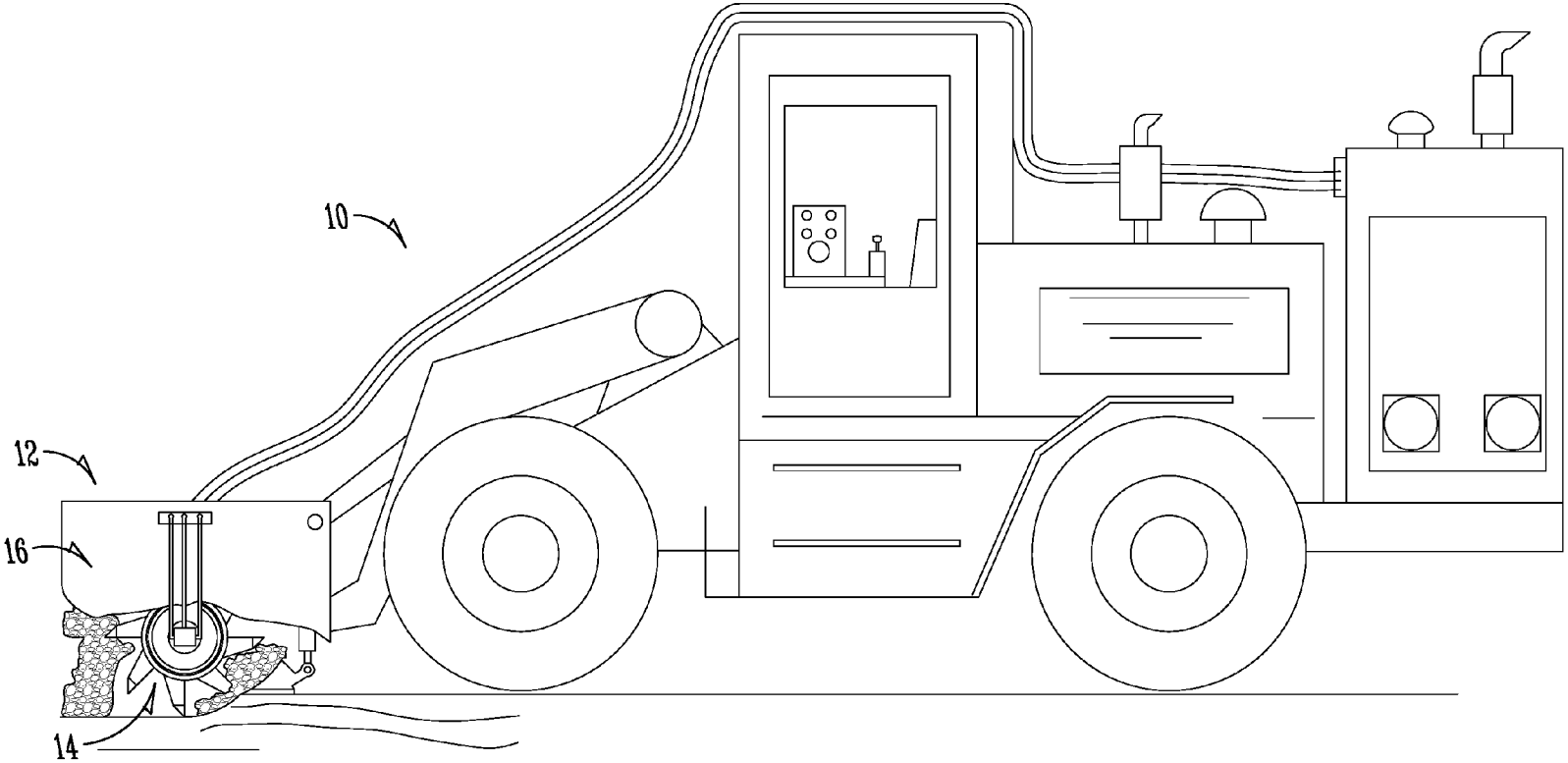
FIG. 1 is a side elevation of a ground working machine including embodiments of this invention.
Figure 2:
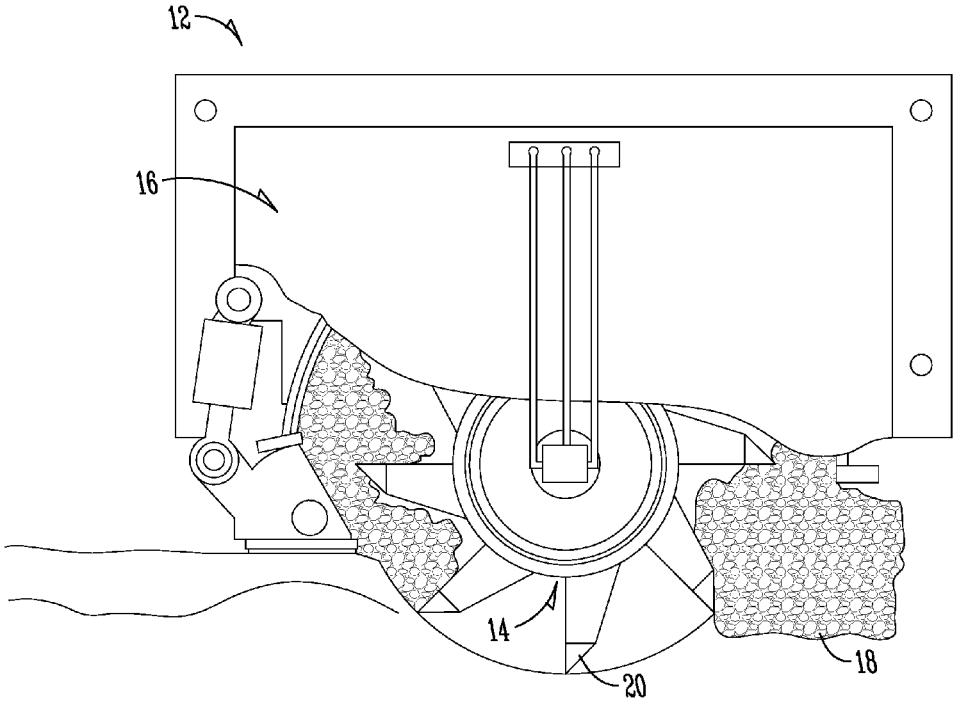
FIG. 2 is an in view partly broken away showing the cutter drum crushing ground materials.
Figure 3:
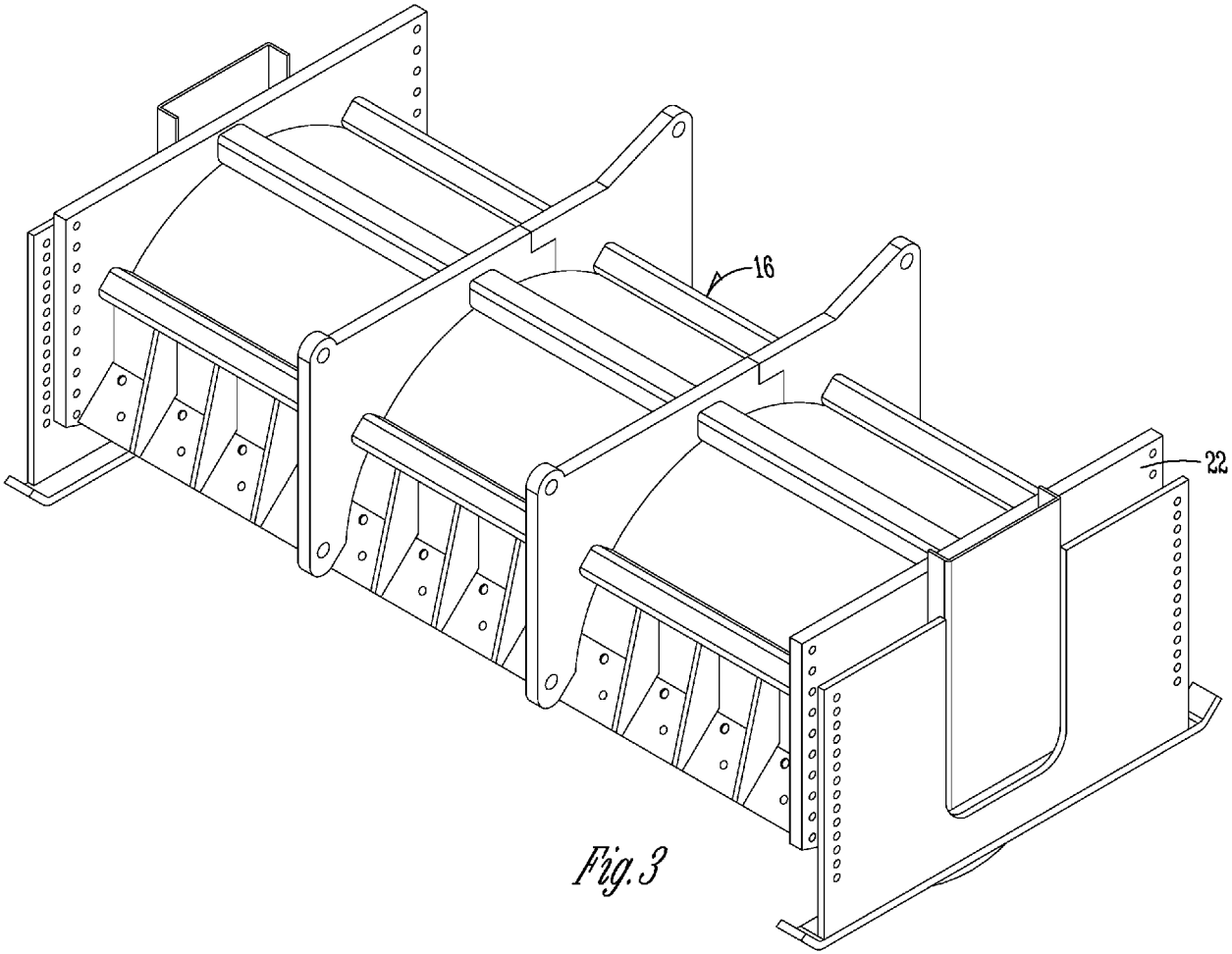
FIG. 3 is a perspective view of the ground breaking machine housing.

The ground breaking or crushing machine of this invention 10 is seen in FIG. 1 having a crusher unit 12 on the front end. The crusher unit 12 has a cutter drum 14 in a housing 16. Ground material 18 is seen in FIG. 2 being crushed by teeth 20 on the cutter drum 14.

Figure 5:
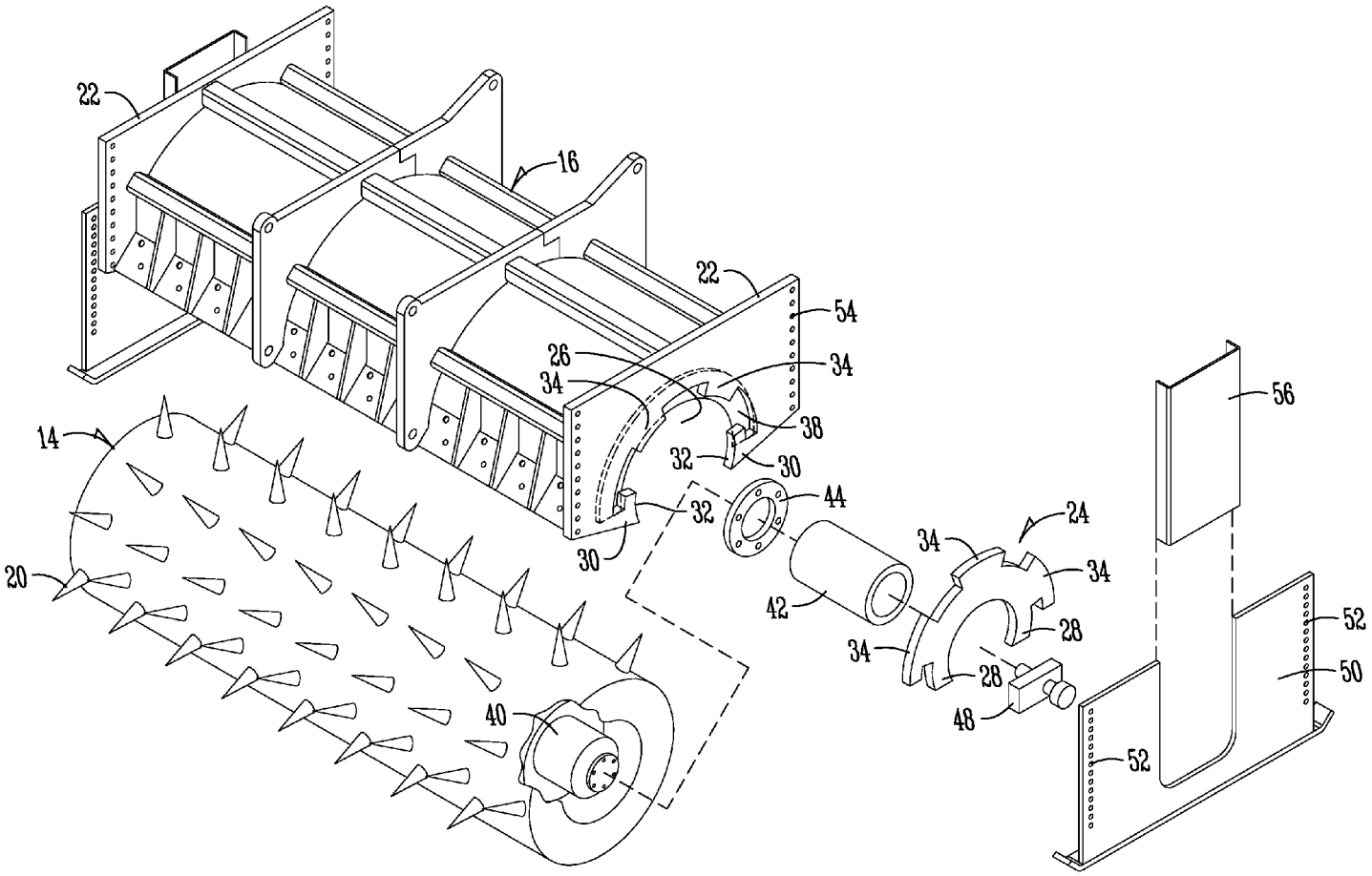
FIG. 5 is an exploded perspective view of the cutter drum, housing and interlocking male plate portion and housing end plate.

As seen in FIG. 5, the cutter housing 16 includes end plates 22 at opposite ends of the cutter housing 16. The end plates 22 have generally semi-circular male plate portions 24 cut out leaving a generally semi-circular female opening 26.

The male plate portion 24 is cut from the end plate 22 to provide a downwardly extending hook portion 28 engagable with the laterally inwardly extending end portion 30 having an upperwardly extending hook portion 32 which prevents separation of the male plate portion 24 from the end plate 22 having the female opening 26. Each of the end plates 22 have and the matching male plate portions 24 include mating interlocking oppositely extending radially extending tabs 34.

Figure 4:
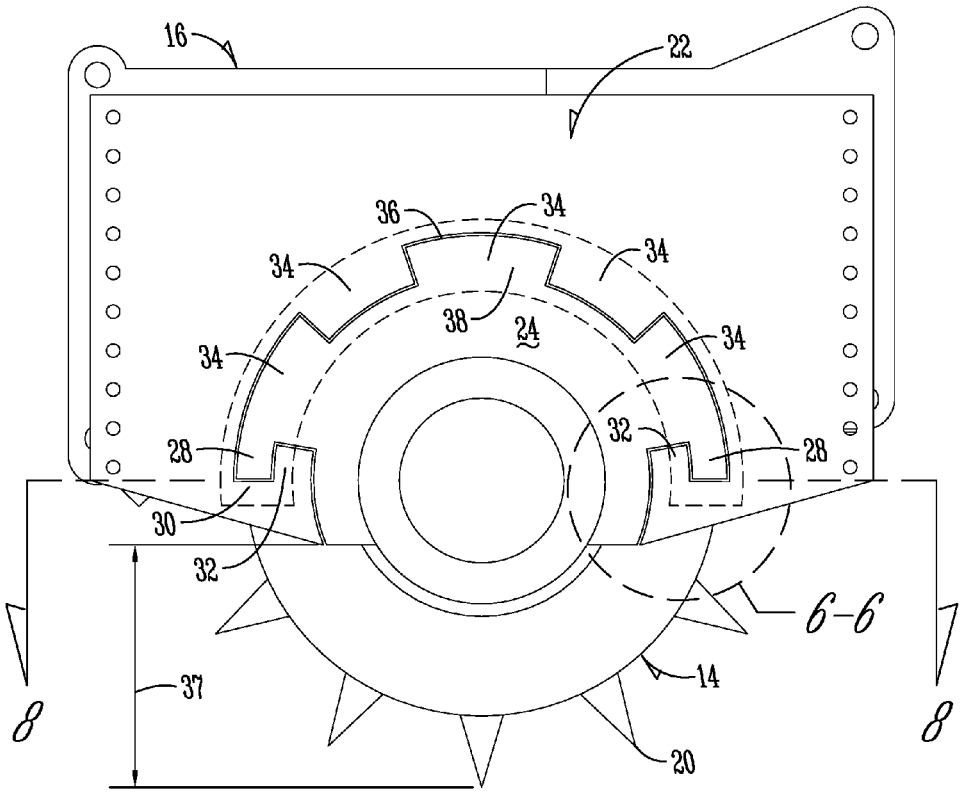
FIG. 4 is an end view of the cutter drum positioned in the housing showing the interlock between the male plate portion and the housing end plate.
Figure 6:
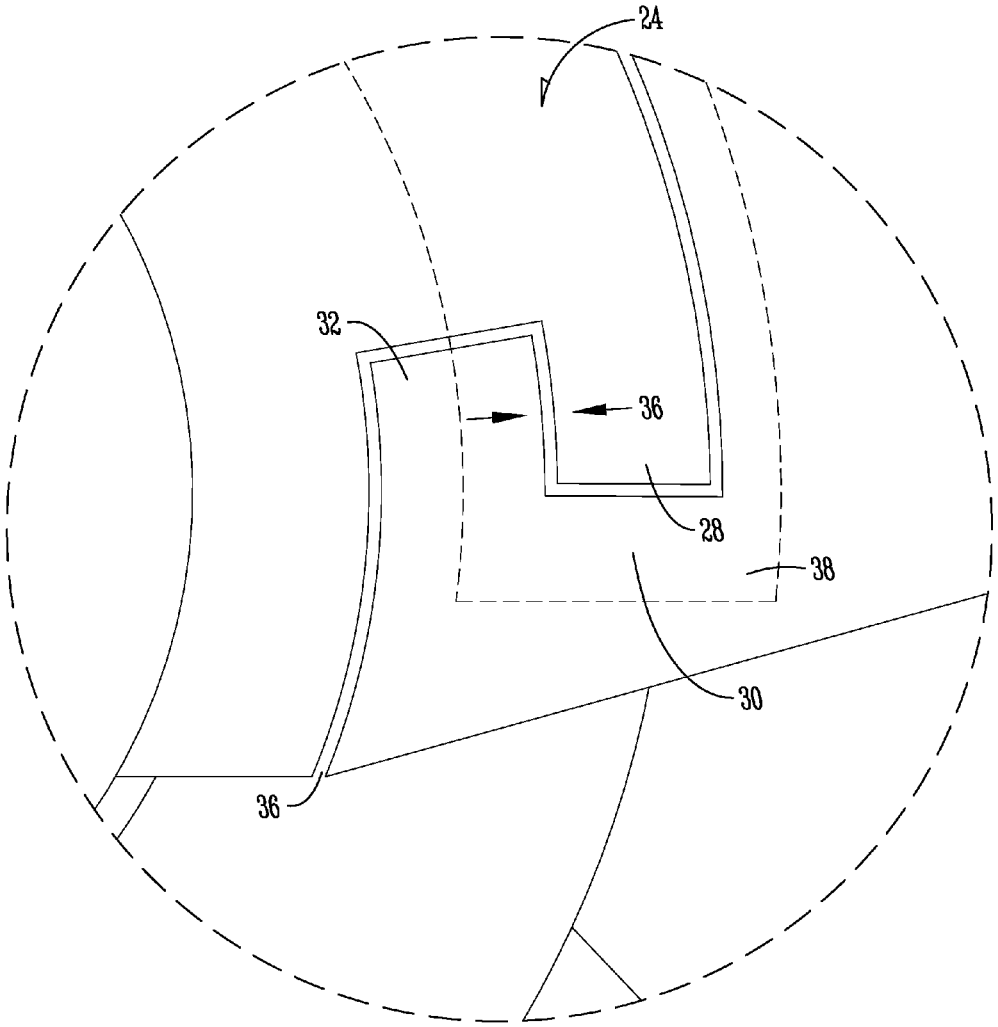
FIG. 6 is an exploded fragmentary view from FIG. 4 showing the male inner lock plate portion in hook engagement with the complimentary female end plate hook portion.

As seen in FIGS. 4 and 6 the male plate portion 24 is positioned in the female opening 26 of the end plate 22 with an enlarged view in FIG. 6 of the interlocking hook portions 28 on the male plate portion 24 and upperwardly extending hook portion 32 on the end plate 22.

Figure 7:
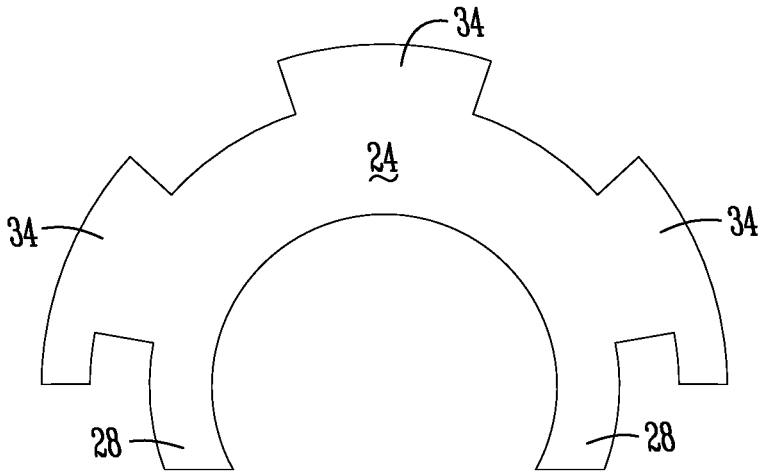
FIG. 7 is a plan view of the male end plate portion showing the inner lock hooks on each side.

It is further seen in FIG. 4 the spacing 37 between the lowest point on the teeth 20 of the cutter drum 14 and the lowest bottom edge of the end plate 22 which is the upperwardly extending hook portion 32 on opposite sides of the female opening 26. Thus, it is seen that the bottom edges of the end plates 22 will not in any way limit the cutting depth of the cutter drum 14 teeth 20. FIG. 7 shows the male plate portion 24 and the interlocking hook portions 28 along with the radially extending tabs 34.

The method of creating the ground breaking machine housing end plate 22 involves the use of a pattern cutting torch which leaves an approximate ⅛ inch width spacing 36 between the male plate portion 24 and the edge of the matching female opening 26 in the end plate 22. The gap or spacing 36 will allow for minuet misalignment during the assembly of the cutter drum 14 in the cutter housing 16. The end plates 22 are two inches thick to provide strength and support for the cutter drum 14.

The male plate portions 24, on the opposite ends of the cutter drum 14 are locked in a vertical plane in the female opening 26 in the end plate 22 by a semi-circular stop element 38 mounted on the inside surface of the end plate 22 overlapping the radially extending tabs 34 as seen in FIGS. 4, 5 and 6.

Figure 8:
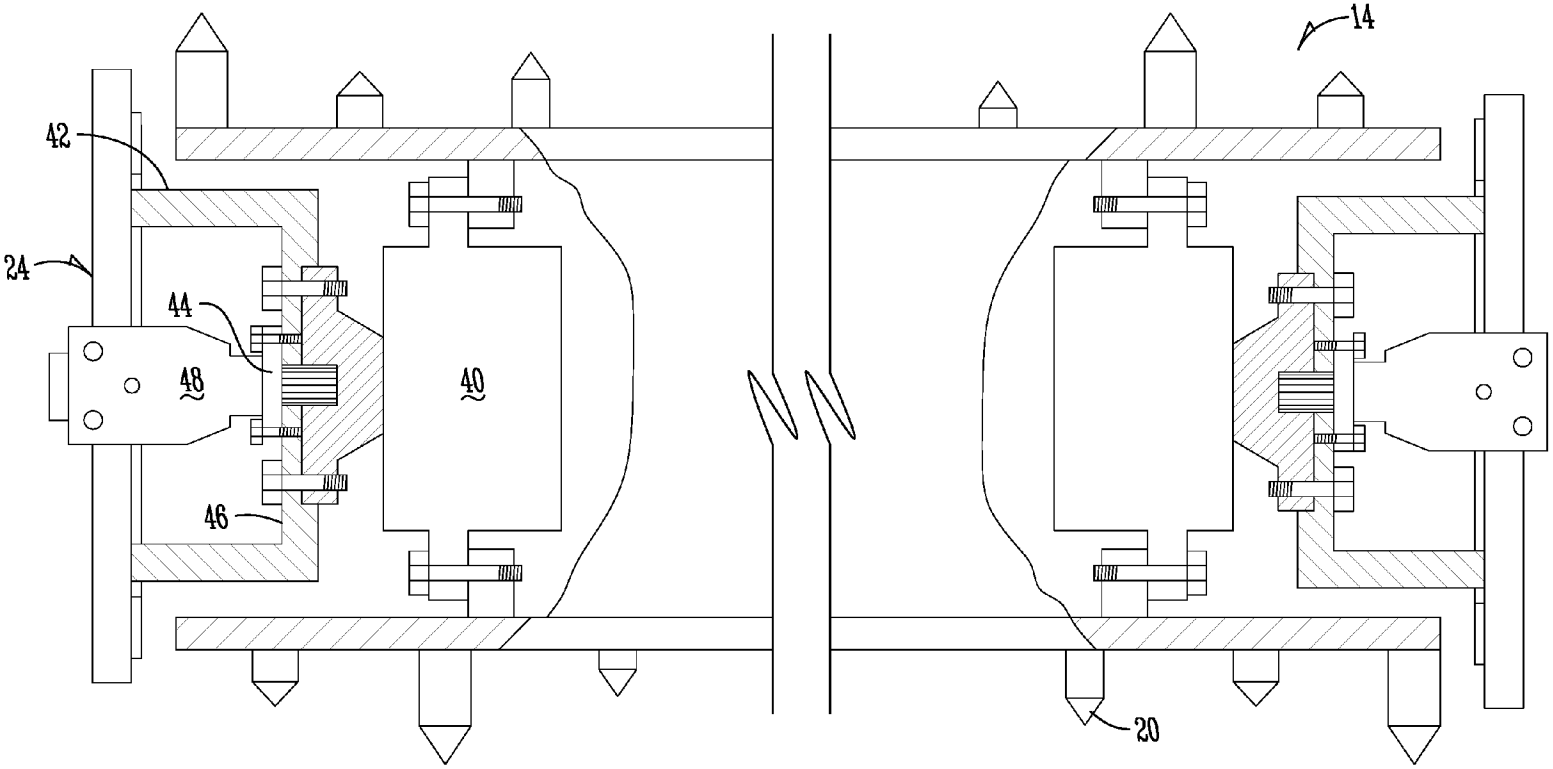
FIG. 8 is a cross sectional view of the assembled cutter drum taken along lines 8-8 in FIG. 4.

In FIG. 5 the component parts are seen in an exploded view before assembly and in FIG. 8 after assembly. A planetary gear 40 is mounted in the outer ends of the cutter drum 14. A bell 42 is welded to the interface of the male plate portion 24 and a flange 44 is connected to the inner end wall 46 of the bell 42. The cutter drum 14 is then positioned under the cutter housing 16 and the assembled components mounted to the male plate portion 24 are then connected to the cutter drum 14 with the end plate portion 24 being received in the female opening 26 in the end plate 22. A hydraulic motor 48 is connected through the flange 44, and bell 42 to the planetary gear 40. Axial movement of the cutter drum 14 is limited by the male plate portions 24 engaging the stop elements 38.

The assembly of the crusher unit 12 is completed by a skid plate 50 being mounted to the end plates 22 by bolts (not shown) received in the openings 52 in the skid plate 50 and openings 54 in the end plate 22. Access to the component parts through the skid plate 50 are possible by removal of a closure plate 56 seen in FIG. 5.

Thus it is seen that the preferred embodiment of this invention permits maximum depth crushing of ground material without limitation by the end plates of the housing by providing an end plate portion interlocked in the mating female opening in the end plate. Additional strength to the end plate is provided by the two inch thickness of the end plate.

What is claimed is:

1. A ground breaking machine having a housing, said housing having oppositely disposed end plates, said end plates including aligned axial female openings and matching male plate portions positioned in said female openings, said female opening being defined by a side edge having top and oppositely disposed vertical spaced apart side edge portions, and each said vertical side edge portion terminating in a laterally inwardly extending end portion having an upwardly extending hook portion engagable with a downwardly extending hook portion on said male plate portion interlocking said female and male hook portions to prevent separation thereof and separation of said male plate portion in said female opening.

2. The ground breaking machine of claim 1 where each of said end plates and said matching male plate portions include mating interlocking oppositely extending radially extending tabs.

3. The ground breaking machine of claim 1 wherein a cutter drum is positioned in said housing, said drum includes opposite ends operatively mounted in an axial opening in said male plate portions.

4. The ground breaking machine of claim 3 wherein said drum includes an inner side wall to which a planetary is mounted, said planetary is connected to a drive motor mounted in said axial opening in one of said male plate portions.

5. The ground breaking machine of claim 3 wherein each of said end plates include a lower edge, and said cutter drum includes teeth on an outer surface of said drum, said lower edge of said end plates being positioned substantially above the teeth on the lower side of said cutter drum.

6. The ground breaking machine of claim 5 wherein said male plate portions have lower edges positioned substantially above the teeth on the lower side of said cutter drum.

* * * * *